US005986404A

United States Patent [19]

Dietze

[11] Patent Number: 5,986,404

[45] Date of Patent: Nov. 16, 1999

[54] LOW VOLTAGE HALOGEN LAMP HAVING A PIN BASE AND A LEAD-IN CONDUCTOR PARTIALLY FUSED INTO THE PIN BASE

[75] Inventor: Werner Dietze, Maienfeld, Switzerland

[73] Assignee: Bruno Dietze, Coburg, Germany

[21] Appl. No.: 09/022,092

[22] Filed: Feb. 11, 1998

[30] Foreign Application Priority Data

Dec. 10, 1997 [DE] Germany ..... 197 54 806

[51] Int. Cl.[6] ..... H01J 5/46

[52] U.S. Cl. ..... 313/623; 313/318.01

[58] Field of Search ..... 313/623, 614, 313/613, 318.01, 491, 633, 631, 35

[56] References Cited

U.S. PATENT DOCUMENTS

| | | | |
|---|---|---|---|
| 4,443,738 | 4/1984 | Roy | 313/491 |
| 5,479,066 | 12/1995 | Willems et al. | 313/318.01 |
| 5,528,105 | 6/1996 | Brinn et al. | 313/518 |

*Primary Examiner*—Nimeshkumar D. Patel
*Assistant Examiner*—Joseph Williams
*Attorney, Agent, or Firm*—Brown & Wood, LLP

[57] ABSTRACT

A current lead-in conductor for an illumination lamp with a glass base and formed of an austenitic stainless steel with additives of Ni and/or Cr, or formed as carrier core made of a non-austenitic carbon steel with alloying additives and surrounded with a Ni-sheath.

2 Claims, 1 Drawing Sheet

LOW VOLTAGE HALOGEN LAMP HAVING A PIN BASE AND A LEAD-IN CONDUCTOR PARTIALLY FUSED INTO THE PIN BASE

BACKGROUND OF THE INVENTION

1. Field of the Invention

The present invention relates to a current lead-in conductor for an illumination lamp with a glass base, which conductor is made of metal.

2. Description of the Prior Art

Illumination lamps include incandescent lamps, gas discharge lamps, flash lamps and the like. An illumination lamp has a hollow glass body and a substantially massive or solid glass base connected with the hollow glass body. The current lead-in conductor is partially fused into the glass base and partially projects outwardly from the base. The current lead-in conductor is a heavy solid body made of an appropriate alloy. The known current lead-in conductors for the illumination lamps are made of an alloy consisting of 98% Ni by weight and 2% Mn by weight. Nickel is a rather expensive metal and, of course, it is desirable to be able to make the current lead-in conductors of a cheaper material. However, the current lead-in conductors should meet certain requirements which the desired cheap materials (substitute metals) should satisfy. These requirements are:

The use of a substitute metal should not make the production of the current lead-in conductors more difficult.

The substitute metal should, during fusing-in of the conductor into the glass base, withstand the fusing temperatures of about 1,200° C.

The substitute metal should have a good electrical conductance to insure current supply into the interior of the illumination lamp.

The substitute metal should have a good heat conductance to be able to carry away heat from the lamp interior.

The substitute metal should be able to withstand operational temperatures of 150–200° C. which prevail at the outwardly projecting portion of the current lead-in conductor.

The substitute metal should have a very good corrosion resistance in the presence of oxygen and heat.

Accordingly, an object of the present invention is to provide a relatively cheap metallic material for making the current lead-in conductors which would meet all of the above-listed requirements.

SUMMARY OF THE INVENTION

This and other objects of the present invention is achieved by using for making the current lead-in conductors a stainless austenitic steel including additives of Cr and/or Ni or by forming the current lead-in conductors as a carrier core made of a carbon steel containing non-austenitic alloying additives and surrounded with a sheath formed of nickel.

In comparison with the conventional materials, the metal, from which the lead-in conductors according to the present invention are made, is much cheaper, e.g., by 20% cheaper than an alloy consisting of 98% of nickel or a pure nickel. Extensive experiments have shown that the lead-in conductor according to the present invention, despite the use of steel materials, is still capable of meeting the requirements with regard to the production, fusing temperatures, electrical conductance, heat conductance, operational temperatures, and corrosion resistance. The lead-in conductor according to the present invention, because of the use of a steel material, has somewhat lower values of electrical conductance and heat conductance than the known lead-in conductors formed of a Ni-Mn alloy. However, somewhat lower values of electrical and heat conductances are very much acceptable because they are still capable of meeting the set requirements.

The stainless steel according to the invention is produced in a form of a wire. As discussed above, in many cases, it includes both Cr and Ni and, often, other additives. The special steel is always corrosion resistant.

The carbon steel, as per se known, contains alloying additives. The nickel-plated sheath which defines the electrical conductance of the inventive lead-in conductor, is formed of a pure nickel or contains up to 2% Mn. The minimal sheath thickness is about several microns and it may reach up to about 15% of the cross-section of the lead-in conductor.

The stainless steel, which is used for manufacturing the lead-in conductor according to the present invention, e.g., x5 CrNi 18/10, material No. 1.4301, DIN 17440, contains 7%C, 17–19% Cr, 8.5–10.5 Ni. A carbon steel, which is used for manufacturing the lead-in conductor according to the present invention, e.g., Db-2, material No. 1.0314 DIN 17140 contains 0.06%C, 0.06Si, 0.4Mn, 0.04Ph, 0.04S.

Generally, the current lead-in conductor according to the present invention is made of a drawn wire and has a diameter up to 4 mm and a length up to 400 mm. The known current lead-in conductors also have these dimensions.

As a rule, the current lead-in conductor according to the present invention is welded, at an end thereof extending in the glass base to a a lead-in wire.

The current lead-in conductor and the sealed pin form together a current lead-in, which itself is a finished product. The a lead-in wire is made e.g., of molybdenum, tungsten or a FeNi-wire having a copper sheath (DUMET™).

The current lead-in conductor according to the present invention is relatively easy welded to the a lead-in wire. The a lead-in wire is partially fused-into the lamp glass base and projects into the interior of the lamp.

A particular preferable and advantageous use of a lead-in conductor according to the present invention takes place when the illumination lamp is a low power lamp up to 50 W and/or when the illumination lamp is a pin-base, low voltage, halogen lamp. Because steel material has a relatively poor heat conductance, the later form of the illumination lamp is particularly suitable for use with the inventive lead-in conductor. It is the relatively poor conductance that make this lamp acceptable for its intended use. A cold light reflector lamp also relates to a pin-base, low voltage halogen lamp.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 3:
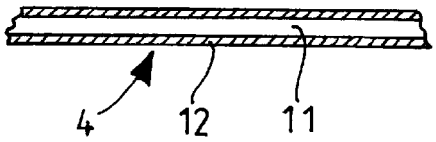
FIG. 3 shows a cross-sectional view of a section of a lead-in conductor.

An illumination lamp according to the present invention, which is shown in the drawings has a hollow glass body 1 which smoothly passes into a massive glass base 2. Two current lead-ins 3 are cast-into the glass base 2. Each lead-in 3 consists of a current lead-in conductor 4 and a a lead-in wire 5 the cross-section of which is smaller than that of the conductor 4. The adjacent ends of the conductor 4 and the a lead-in wire 5 abut each other and are connected with each other by a weld 6. Both lead-in wires project into the glass body 1, with their free ends carrying a filament 7 made of tungsten.

Figure 1:
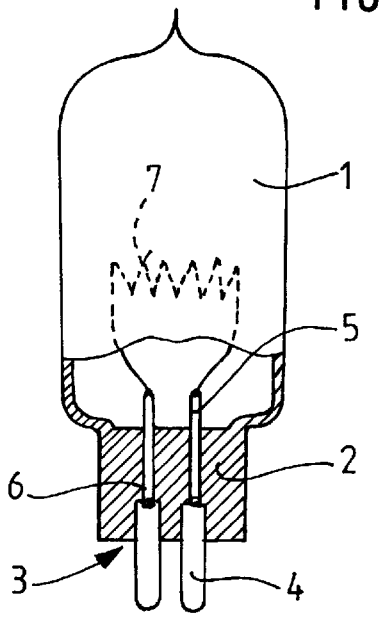
FIG. 1 shows schematically a side, partially cross-sectional view of a first embodiment of an illumination lamp, together with lead-in current conductors, according to the present invention.

FIG. 1 shows a pin-base, low voltage halogen lamp. The lead-in wires 5 project into the glass body 1 and are directly connected with the filament 7.

Figure 2:
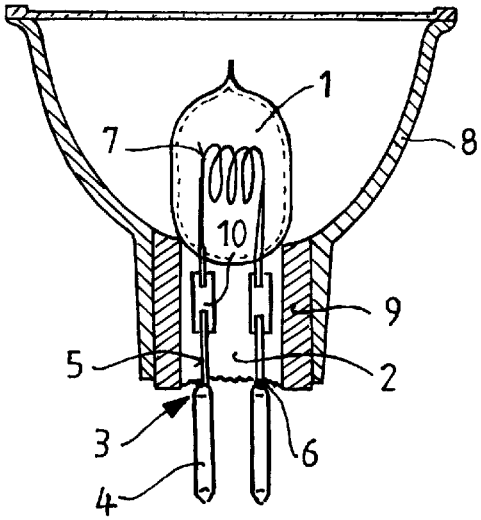
FIG. 2 shows schematically a cross-sectional view of a second embodiment of all illumination lamp, together with lead-in conductors, according to the present invention.

FIG. 2 shows a cold light reflector lamp formed as a pin-base, low voltage halogen lamp with a glass reflector 8, which is secured to the glass base 2 with putty 9. The lead-in wires 5 end in the glass base 2 and are connected with the filament 7 by an intermediate member 10.

FIG. 3 shows a section of lead-in conductor 4 according to the present invention which is formed as a Ni-plated core. It includes a core 11 and a sheath 12.

The current lead-in conductors according to the invention, as discussed above, are made of a austenitic steel including Cr and/or Ni additive or of carbon steel with non-austenitic alloying additives. In the later case they are made as core with a Ni sheath.

Though the present invention was shown and described with reference to the preferred embodiment, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A low-voltage pin-base halogen lamp, comprising a hollow glass body; a solid glass base formed integrally with the hollow glass body; lead-in wire means fused in the glass base and having an end portion projecting into an interior of the hollow glass body; and a lead-in pin-shaped conductor having a first portion extending into the glass base and welded therein to the lead-in wire means and a second portion projecting outwardly from the glass base;

wherein the lead-in pin-shaped conductor is formed of an austenitic stainless steel with at least one additive selected from a group consisting of Cr and Ni, and wherein the lead-in pin-shaped conductor is formed as a section of a drawn wire and has a diameter up to 4 mm and a length up to 400 mm.

2. A low-voltage pin-base halogen lamp, comprising a hollow glass body; a solid glass base formed integrally with the hollow glass body; lead-in wire means fused in the glass base and having an end portion projecting into an interior of the hollow glass body; and a lead-in pin-shaped conductor having a first portion extending into the glass base and welded therein to the lead-in wire means and a second portion projecting outwardly from the glass base;

wherein the lead-in pin-shaped conductor has a carrier core formed of a non-austentic carbon steel having an alloying additive, and a Ni-sheath surrounding the carrier core, and wherein the lead-in pin-shaped conductor is formed as a section of a drawn wire and has a diameter up to 4 mm and a length up to 400 mm.

* * * * *